US005218372A

United States Patent [19]

Cheng

[11] Patent Number: 5,218,372

[45] Date of Patent: Jun. 8, 1993

[54] WIDE BAND SPHERICAL ANTENNA WITH IMPROVED IMPEDANCE-MATCHING CIRCUIT

[76] Inventor: Chen-Sheng Cheng, No. 18-4, Wan Haw Street, Pin Jen City, Yao Yuan Hsien, Taiwan

[21] Appl. No.: 884,715

[22] Filed: May 15, 1992

[51] Int. Cl.[5] ..... H01Q 9/00

[52] U.S. Cl. ..... 343/749; 343/860; 343/906; 343/899

[58] Field of Search ..... 343/749, 745, 898, 899, 343/860, 862, 702, 906

[56] References Cited

U.S. PATENT DOCUMENTS

| | | | |
|---|---|---|---|
| 3,268,897 | 8/1966 | Link | 343/749 |
| 3,774,221 | 11/1973 | Francis | 343/749 |
| 3,852,757 | 12/1974 | Kaiser | 343/906 |

*Primary Examiner*—Rolf Hille
*Assistant Examiner*—Hoanganh Le
*Attorney, Agent, or Firm*—W. Wayne Liauh

[57] ABSTRACT

A new wide-frequency-band spherical antenna structure which comprises a spherical antenna, an insulating sleeve, an impedance-matching element, a fixed disc, a center-needle seat, and a socket member with a high-frequency connector; the impedance-matching element (inductance coil) is to be fitted in the spherical antenna and the socket member; the impedance-matching element and the socket member of the high-frequency connector form an impedance-matching network to provide a nominal capacitance; the structure not only can facilitate the assembling procedures thereof, but also can omit the test and adjustment procedures as required by the conventional antenna; moreover, such an antenna has a small size without affecting the excellent reception efficiency.

2 Claims, 4 Drawing Sheets

WIDE BAND SPHERICAL ANTENNA WITH IMPROVED IMPEDANCE-MATCHING CIRCUIT

BACKGROUND OF THE INVENTION

All communication equipment have to use antenna to receive and transmit signals. Usually, the impedance of a reception or transmission terminal is designed with an impedance ranging from 50 to 75 ohms (which varies according to the design of a specific instrument); the aforesaid impedance value is quite different from the impedance (over 377 ohms) of the free space, and therefore the matching result is poor. In order to obtain a better result an antenna has to be used for a better impedance match and for a better signal strength. If the antenna of an equipment is not properly designed, the poor impedance match would cause the signal to experience a considerable amount of fading; in other words, the design of an antenna is quite important to a communication equipment; a properly designed antenna can have the characteristics of an equipment performed fully, i.e., to have a signal reached a faraway place. Otherwise, an equipment would be unable to show its functions, or even to shorten its serviceable life. Usually, the function of an antenna is limited by terrain feature and buildings, and therefore it has to be turned and adjusted in the direction facing the transmitter. Such adjustment would result in an inconvenience to a long pole-shaped antenna, which is usually an extension type and bendable to facilitate storage; however, its complex structure would cause a higher manufacturing cost.

SUMMARY OF THE INVENTION

This invention relates to a new wide-frequency-band spherical antenna structure, which comprises a spherical antenna, an insulating sleeve, an impedance-matching element with a fixed disc, a center-needle seat, and a socket member having a high-frequency connector. The impedance-matching element (inductance coil) is to be inserted in a space formed by the spherical antenna and the socket member. The spring-shaped impedance-matching element and the socket member of the high-frequency connector form an impedance-matching network to generate an electrostatic (or nominal) capacitance. The prime feature of the present invention is to facilitate assembling procedures without test and adjustment using a testing instrument; further, the present invention has a small size, i.e., about 3 c.m. high, but its reception efficiency is superior to a conventional antenna.

BRIEF DESCRIPTION OF THE DRAWINGS

FIG. 4-1 is a sectional view of a coaxial transmission line in the present invention.

FIG. 4-2 is an equivalent impedance circuit.

FIG. 4-3 is an impedance-matching diagram.

FIG. 4-4 is a block diagram, showing a two-section impedance-matching network.

FIG. 4-5 is an equivalent circuit of FIG. 4-4.

DETAILED DESCRIPTION

Figure 1:
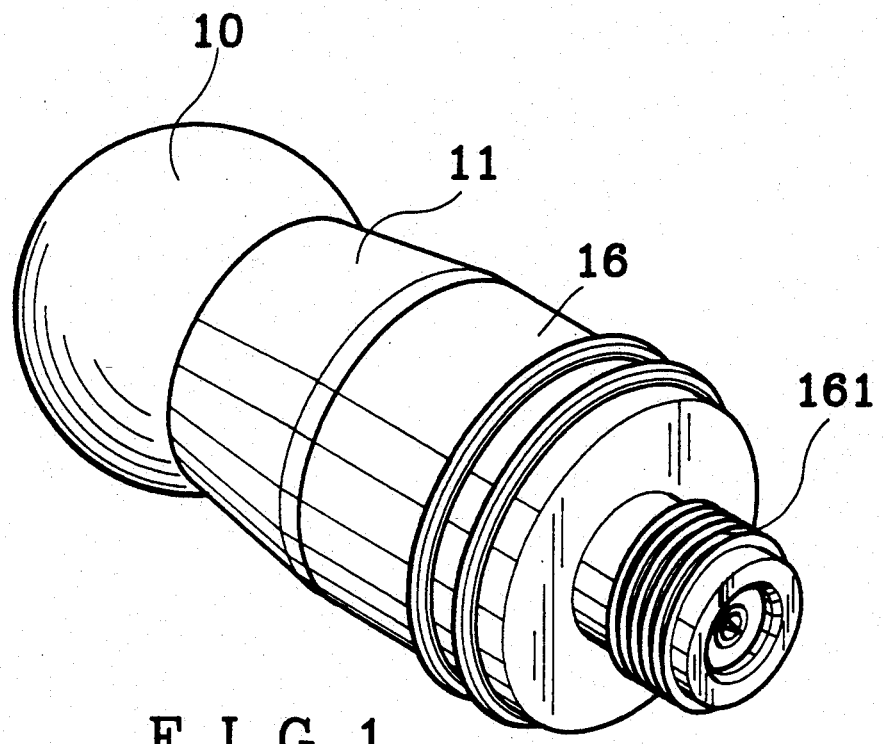
FIG. 1 is a perspective view of an embodiment according to the present invention.
Figure 2:
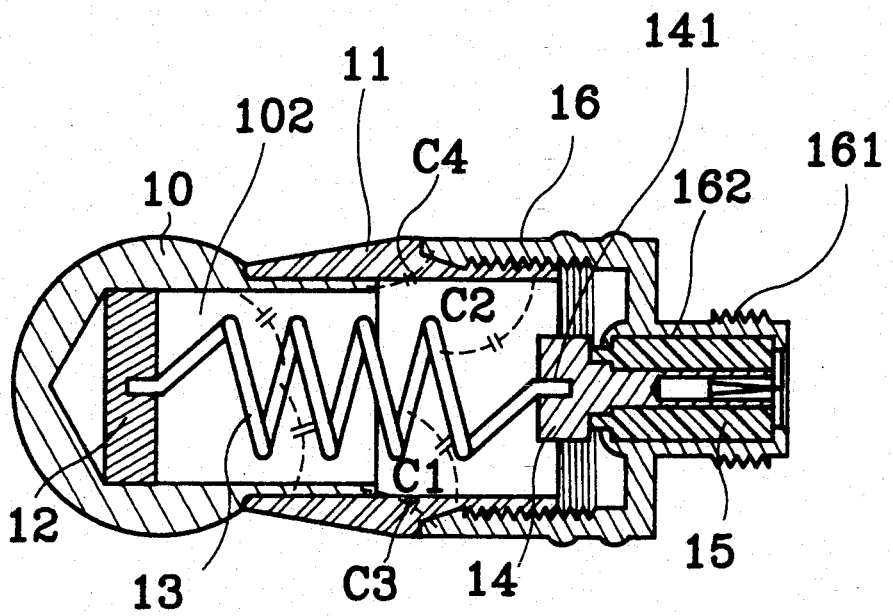
FIG. 2 is a sectional view of the present invention.
Figure 3:
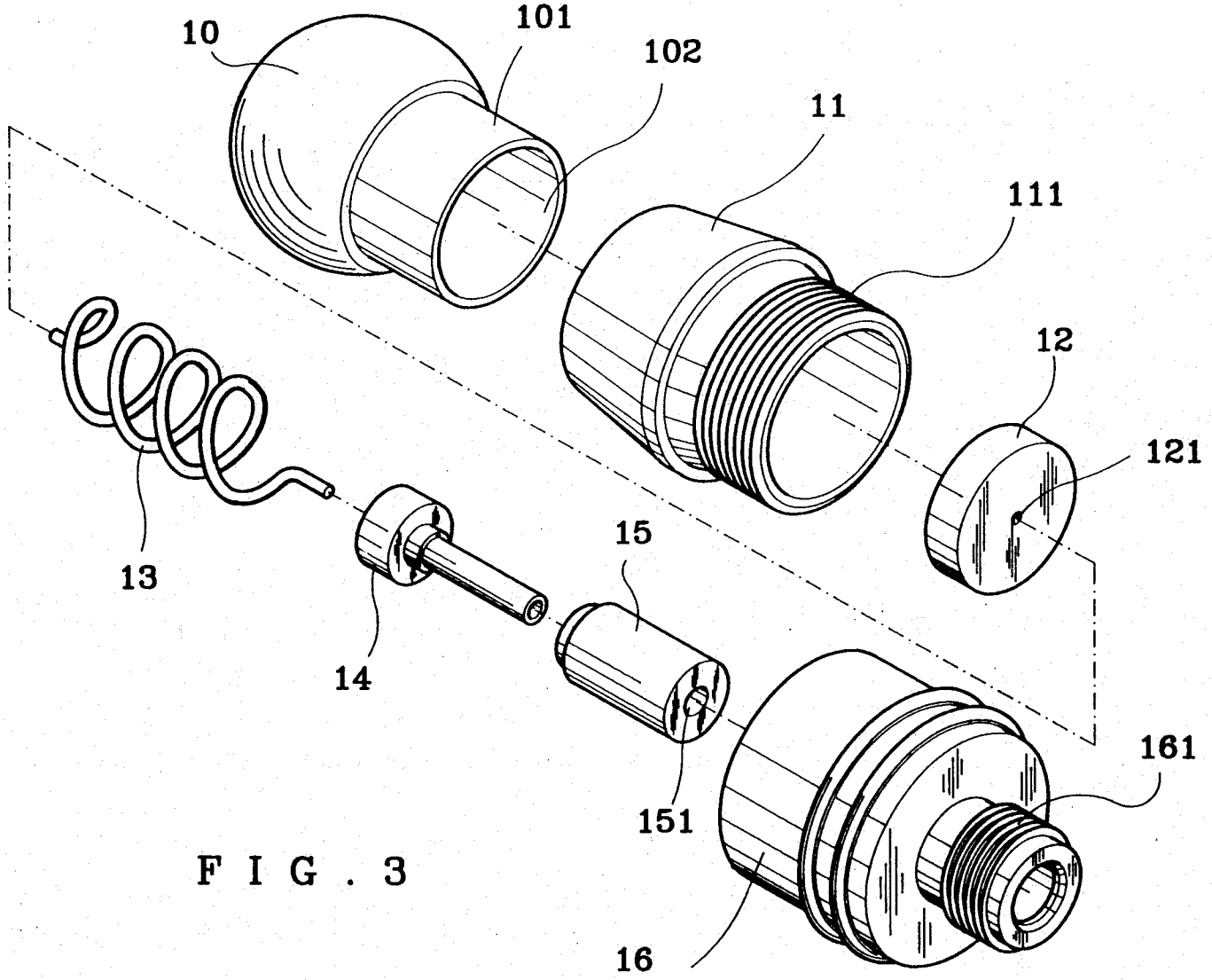
FIG. 3 is a disassembled view of the present invention.
Figures 1, 4:
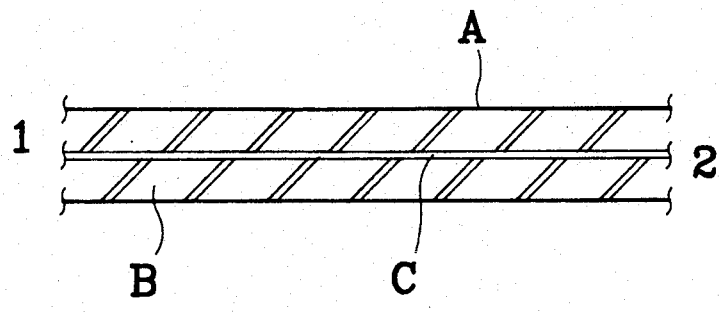
Figures 2, 4:
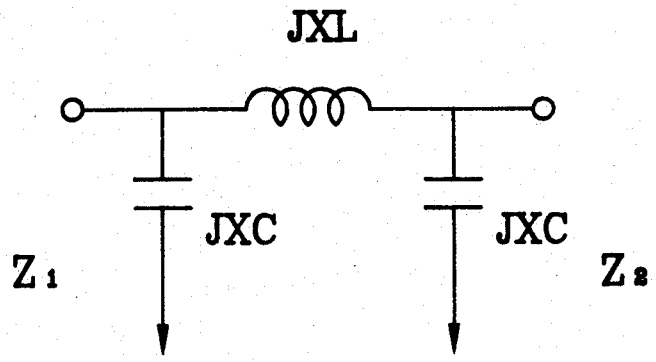
Figures 3, 4:
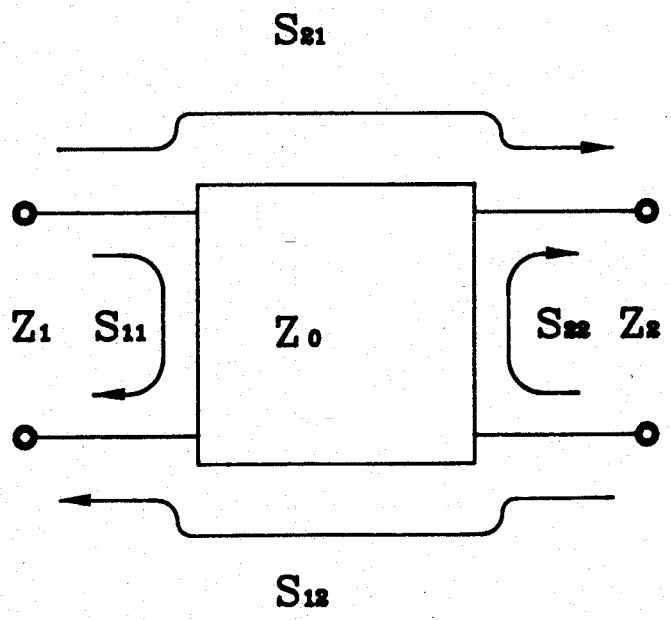
Figure 4:
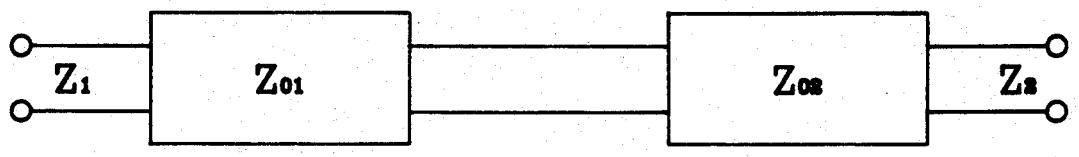
Figures 4, 5:
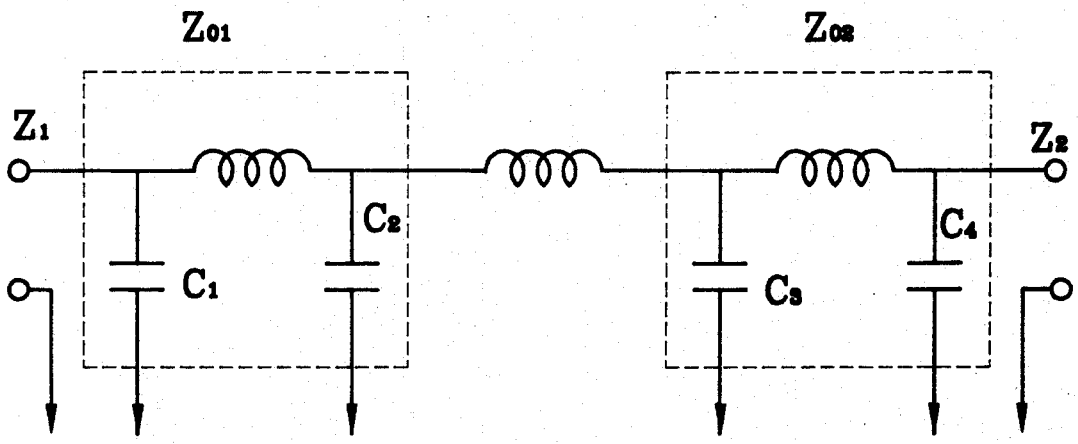

Referring to FIGS. 1 and 2, the present invention is shown with a perspective view and a sectional view respectively; the present invention comprises a spherical antenna 10, an insulating sleeve 11, a fixed disc 12, a spring-shaped impedance-matching element 13, a center-needle seat 14 and a socket member 16 having a high-frequency connector 161. The spherical antenna 10 is made of metal, and the front end thereof has a connecting sleeve 101 (as shown in FIG.), which is mounted and glued inside the insulating sleeve 11. The spherical antenna 10 has a deep hole 102, in which a fixed disc 12 is mounted to allow the spherical antenna to be electrically connected with one end of the impedance-matching element 13. The front end of the insulating sleeve 11 is furnished with fastening threads 111, whereby the insulating sleeve 11 can be mounted in the socket member 16. The hollow space inside the insulating sleeve 11 and the socket member 16 is installed with an impedance-matching assembly, which includes an impedance-matching element (inductance coil) 13; one end of the element 13 is inserted into a fastening hole 141 of the center-needle seat 14, of which the front end is fitted in a hole 151 of an insulator 15; the insulator 15 is fitted in a hole 162 in the front end of the socket member 16. The socket member is made of metal, and the front end thereof has a high-frequency connector 161 with threads. The theory and the wideband frequency characteristics of the embodiment according to the present invention are briefly described as follows:

FIG. 4-1 illustrates a sectional view of a coaxial transmission line for high frequency transmission; "A" in FIG. 4-1 stands for ground, and "B" stands for an insulator; "C" stands for an axial wire in the center thereof. FIG. 4-2 is an equivalent impedance circuit of the FIG. 4-1, of which the value of impedance is determined by its structure (i.e., diameter and material used); different frequency would result in different impedance (R+JX) as shown in FIG. 4-2. The basic method of impedance matching is shown in FIG. 4-3, in which $Z_0$ stands for the impedance value, i.e., $Z_0=\sqrt{Z_1 \times Z_2}$; and $Z_1$ and $Z_2$ stand for the impedances of terminals 1 and 2 respectively. If the terminal is the output terminal of an equipment, $Z_2$ is the impedance of the free space. FIG. 4-3 illustrates a diagram, whereby a basic impedance match can be obtained; however, the aforesaid basic impedance match is unable to meet the requirement of a special and complicated wide frequency band (i.e., higher than 12%). In that case, a two-section or more than two-section matching network is required as shown in FIG. 4-4. As shown in FIG. 4-5, the size of the parts therein may vary in accordance with the different frequency bands. Since different impedances exit between the coil and the spherical top, and between the coil and the base part, the electrostatic (or nominal) capacitance among the aforesaid parts forms a part of the impedance-matching circuit.

In brief, the present invention is designed in accordance with a new idea and a theory; the height of the antenna has largely been reduced (about 3 c.m.), and the spherical antenna can pick up a signal at an angle of 360 degrees without requiring to adjust the antenna for different terrain and direction. Moreover, the present invention is simple in assembling procedures without complicated tests and adjustments; in other words, the manufacturing efficiency thereof can be increased.

I claim:

1. A wide-frequency-band spherical antenna structure comprising:

a spherical antenna having a hollow space and a connecting sleeve extended therefrom;

an insulating sleeve having an upper portion adapted to be sleeved about said connecting sleeve and a lower portion having a threaded outer periphery;

a socket member having a threaded inner periphery on the upper portion thereof for threadably receiving said lower portion of said insulating sleeve and a high-frequency connector on the lower portion thereof;

a spring-shaped impedance-matching element disposed within said hollow space of said spherical antenna and said insulating sleeve, said impedance member having a first end and a second end;

a fixed disc disposed within said hollow space of said spherical antenna to allow electrical connection between said first end of said impedance-matching element and said spherical antenna;

a center-needle seat affixed but electrically insulated from said high-frequency connector, said center-needle having a fastening hole for receiving said second end of said impedance-matching element;

whereby said connecting sleeve of said spherical antenna, said insulating sleeve and said socket member form a first impedance-matching circuit, and said spring-shaped impedance-matching member, said insulating sleeve and said socket member form a second impedance-matching circuit.

2. The wide-frequency-band spherical antenna structure of claim 1 wherein said upper portion of said socket member and said lower portion of said insulating sleeve are glued together.

* * * * *